US010933636B2

(12) United States Patent
Volkel et al.

(10) Patent No.: US 10,933,636 B2
(45) Date of Patent: Mar. 2, 2021

(54) PRINT HEAD DESIGN FOR BALLISTIC AEROSOL MARKING WITH SMOOTH PARTICULATE INJECTION FROM AN ARRAY OF INLETS INTO A MATCHING ARRAY OF MICROCHANNELS

(71) Applicant: Palo Alto Research Center Incorporated, Palo Alto, CA (US)

(72) Inventors: Armin R. Volkel, Mountain View, CA (US); Eugene M. Chow, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 236 days.

(21) Appl. No.: 14/099,873

(22) Filed: Dec. 6, 2013

(65) Prior Publication Data

US 2015/0158295 A1 Jun. 11, 2015

(51) Int. Cl.
*B41J 2/14* (2006.01)
*B41J 2/04* (2006.01)

(52) U.S. Cl.
CPC ..... *B41J 2/1433* (2013.01); *B41J 2/04* (2013.01); *B41J 2/14* (2013.01); *B41J 2202/02* (2013.01)

(58) Field of Classification Search
None
See application file for complete search history.

(56) References Cited

U.S. PATENT DOCUMENTS 4,822,267 A * 4/1989 Walz ..... B22F 9/082 264/12
6,116,718 A 9/2000 Peeters et al.
6,293,659 B1 9/2001 Floyd et al.
6,328,409 B1 12/2001 Peeters et al.
6,328,436 B1 12/2001 Floyd et al.
6,416,159 B1 7/2002 Floyd et al.
6,416,158 B1 9/2002 Floyd et al.
6,511,149 B1 1/2003 Peeters et al.
6,511,850 B1 * 1/2003 Vigh et al. ..... 436/127
7,938,341 B2 5/2011 King et al.
2002/0137085 A1 * 9/2002 Herrick ..... B01J 19/0046 435/6.12
2006/0119667 A1 6/2006 Lean et al.
2008/0038152 A1 * 2/2008 Van Pelt ..... 422/63

FOREIGN PATENT DOCUMENTS

WO WO03/091460 11/2003
WO WO2009029942 3/2009

OTHER PUBLICATIONS

Volke, A, et al., "Ballistic Aerosol Marking", Solid-State Sensors, Acutators, and Microsystems (Transducers & Eurosensors XXVII), pp. 2385-2388 (2013).
Office Action dated Apr. 28, 2015 from EP Application No. 14194641.0, 6 pages.

* cited by examiner

*Primary Examiner* — Alejandro Valencia
(74) *Attorney, Agent, or Firm* — Mueting Raasch Group

(57) ABSTRACT

Disclosed herein is a material ejector (e.g., print head) geometry having alignment of material inlet channels in-line with microchannels, symmetrically disposed in a propellant flow, to obtain smooth, well-controlled, trajectories in a ballistic aerosol ejection implementation. Propellant (e.g., pressurized air) is supplied from above and below (or side-by-side) a microchannel array plane. Obviating sharp (e.g., 90 degree) corners permits propellant to flow smoothly from macroscopic source into the microchannels.

17 Claims, 11 Drawing Sheets

PRINT HEAD DESIGN FOR BALLISTIC AEROSOL MARKING WITH SMOOTH PARTICULATE INJECTION FROM AN ARRAY OF INLETS INTO A MATCHING ARRAY OF MICROCHANNELS

BACKGROUND

The present disclosure relates generally to the field of material delivery systems and methods, and more particularly to systems and methods capable of delivering a material to a substrate by introducing the marking material into a high-velocity propellant stream.

Ink jet is currently a common technology for delivering a marking material to a substrate. There are a variety of types of ink jet printing, including thermal ink jet (TIJ), piezoelectric ink jet, etc. In general, liquid ink droplets are ejected from an orifice located at one terminus of a channel opposite a marking material reservoir. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. Many of these disadvantages are a function of the intended use for the material delivery system. For example, perhaps the most common application of TIJ technology is printing or similar substrate marking. In such an application, there is a desire to reduce the printed spot size and pitch in order to increase printing resolution. There is further a desire to provide improved spot-size control and hence improved greyscale printing. Printing speed and system reliability are additional areas in which improvements are desired. Another drawback of previous ejector systems is the high shear stress imposed on the ejected material by the reliance on small exit holes to create small jets. For applications with delivery payloads sensitive to mechanical stress, this approach is problematic. For example, for drug delivery applications, where the delivered material could be a pharmaceutical composed of proteins, nucleic acids (DNA/RNA) or biologics, high shear stress could damage the payload and reduce therapeutic potency. Ballistic aerosol marking (BAM) has been identified as one technology that may address and overcome the shortfalls of other known material transfer systems and methods. See, for example, the efforts to overcome know limitations on TIJ resolution discussed and disclosed in U.S. Pat. No. 6,416,159, which in its entirety is incorporated herein by reference.

In certain embodiments of ballistic aerosol marking systems and methods, a fluid or particulates are deposited on a substrate using a continuous, fast flowing (e.g., super-sonic) jet. According to certain systems and methods, a carrier (e.g., air) is accelerated and focused through an array of microchannels each coupled to a Laval nozzle. Liquid or particulate material is introduced into the carrier stream. The material may be supplied through inlets perpendicular to microchannels just beyond the Laval nozzles. However, such systems present a number of complications, including high viscous losses of the air jet due to the narrow cross-section of the relatively long microchannels (e.g., 3000 μm in length with a 65 μm×65 μm cross-section), vortex formation inside the toner inlets due to their vertical alignment with respect to the main air flow direction, material jet defocussing due to particulate materials introduced into the jet hitting the side walls of the channels, and so on.

While TIJ has been discussed above as a background technology motivating the exploration of BAM and the present disclosure, other technologies that may be relevant include electrostatic grids, electrostatic ejection (or tone jet), acoustic ink printing, and certain aerosol and atomizing systems such as dye sublimation. Furthermore, while the background has been framed initially in terms of application of marking material to a substrate, it will be appreciated that the scope of the present disclosure is not so limited, but applies to a wide variety of fluid and particulate delivery systems and methods such as may be used for chemical and biological research, manufacturing, and testing, surface and sub-dermal medicine and immunization delivery, drug delivery, micro-scale material manufacturing, three-dimensional printing, and so on.

SUMMARY

Accordingly, the present disclosure is directed to systems and processes for providing improved control over particle velocities, trajectories, and target accuracy in a ballistic aerosol marking apparatus. While the term "marking" is used herein with reference to the disclosed ballistic aerosol marking print heads, the application of the present disclosure is intended to encompass more than marking, and may include delivery of a wide variety of materials for a wide variety of purposes, including but not limited to delivery of marking materials (for marking both visible and not visible to the unaided eye), surface finish material, chemical and biological materials for experimentation, analysis, manufacturing, and therapeutic use, materials for micro- and/or macro-scale manufacturing (e.g., three-dimensional printing), surface and sub-dermal medicine and immunizations, etc. Further, while "particulate" may be used in various examples herein, these descriptions are merely examples, and generally the material delivered by systems of the type described herein are not specifically limited to particulates. Still further, while "print head" is used in the description of various embodiments herein, such a structure may generalize to a material ejector, such as in embodiments contemplated herein that are not tied to a printing functionality, such as the delivery functionalities discussed above.

This disclosure further applies to the general application of drug delivery, referring to transporting of any material towards biological samples for medicinal purposes. This includes transdermal and transmucosal routes amongst others and includes material target depths of at the surface, shallow and deep into the biological samples. Biological samples include living cells in all forms, including tissue on living organisms or cells supported by artificial means (in vitro).

Disclosed herein is a material ejector geometry having alignment of material inlet channels in-line with microchannels to obtain smooth, well-controlled, ejection trajectories. Propellant (e.g., pressurized air) is supplied from above and below a microchannel array plane. By avoiding any sharp (e.g., 90 degree) corners, propellant flow passes smoothly from macroscopic source into the microchannels. An electrostatic transport subsystem, such as a "μAtom mover", may optionally be used to controllably provide material to the channel exits. Arrays of microchannels may be etched into Si wafers, but can alternatively be etched into polymer layers laminated onto glass substrates.

With the design disclosed herein, resolution of the print head is determined by the density of μAtom movers, gating electrodes, and microchannels employed. In one example, microchannels and μAtom movers provide a print resolution of up to 300 dpi.

According to one aspect, an apparatus for selectively depositing a particulate material onto a substrate is disclosed comprising: a print head body defining a nozzle and an exit channel therein; a particulate inlet channel disposed within the nozzle and substantially uniformly spaced apart from at least first and second opposite surfaces of the nozzle to thereby define substantially symmetrical first and second flow regions between the particulate inlet channel and the at least two opposite surfaces of the nozzle; a particulate reservoir communicatively coupled to the particulate inlet channel for delivery of particulate material; a propellant source communicatively coupled to the nozzle; the particulate inlet channel disposed relative to the propellant source and within the nozzle such that propellant provided by the propellant source may flow substantially uniformly past the particulate inlet channel within the first and second flow regions; whereby particulate material may be provided by the particulate reservoir to the particulate inlet channel, carried from the particulate inlet channel by propellant flowing substantially uniformly past the particulate inlet channel within the first and second flow regions, and carried by the propellant to exit the print head body through the exit channel toward the substrate.

Implementations of this aspect may also include one or more of: a microchannel disposed within the exit channel; the microchannel comprising wall structures defining a nozzle profile therein; the wall structure comprises a longitudinal body having a proximal end and a distal end, and wherein the proximal end comprises an end treatment selected from the group consisting of: a radius planform, a wedge planform, and an angled planform.

According to one or more additional aspects of the disclosure: the particulate inlet channel may be provided with at least one electrostatic particulate transport subsystem; the particulate inlet channel may be provided with a plurality of independently controllable electrostatic particulate transport subsystems; the apparatus may further comprise a plurality of particulate reservoirs, each of the particulate reservoirs communicatively coupled to an independently controllable electrostatic particulate transport subsystem.

Implementations may also include a controller for controlling the at least one electrostatic particulate transport subsystem as a function of propellant flow velocity between the particulate inlet channel and the exit channel, and optionally a flow sensor communicatively coupled to the controlled and disposed with a region between the particulate inlet channel and the exit channel, the controller controlling the at least one electrostatic particulate transport subsystem responsive to data provided by the flow sensor.

The above is a brief summary of a number of unique aspects, features, and advantages of the present disclosure. The above summary is provided to introduce the context and certain concepts relevant to the full description that follows. However, this summary is not exhaustive. The above summary is not intended to be nor should it be read as an exclusive identification of aspects, features, or advantages of the claimed subject matter. Therefore, the above summary should not be read as imparting limitations to the claims nor in any other way determining the scope of said claims.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

A print head design according to the present disclosure provides a smooth injection of particulates into an air stream of a ballistic aerosol marking system. Particulate inlets and microchannels are aligned in-line with each other, as opposed to the known arrangement of orienting the particulate inlets and microchannels generally perpendicular to one another. The continuous air stream is focused into the microchannels through a nozzle that is symmetric around the particulate inlets. With this geometry, particulate injection is in the same plane as the microchannels, while the air is supplied from the third dimension (i.e., from below and above the microchannel array plane).

Figure 1:
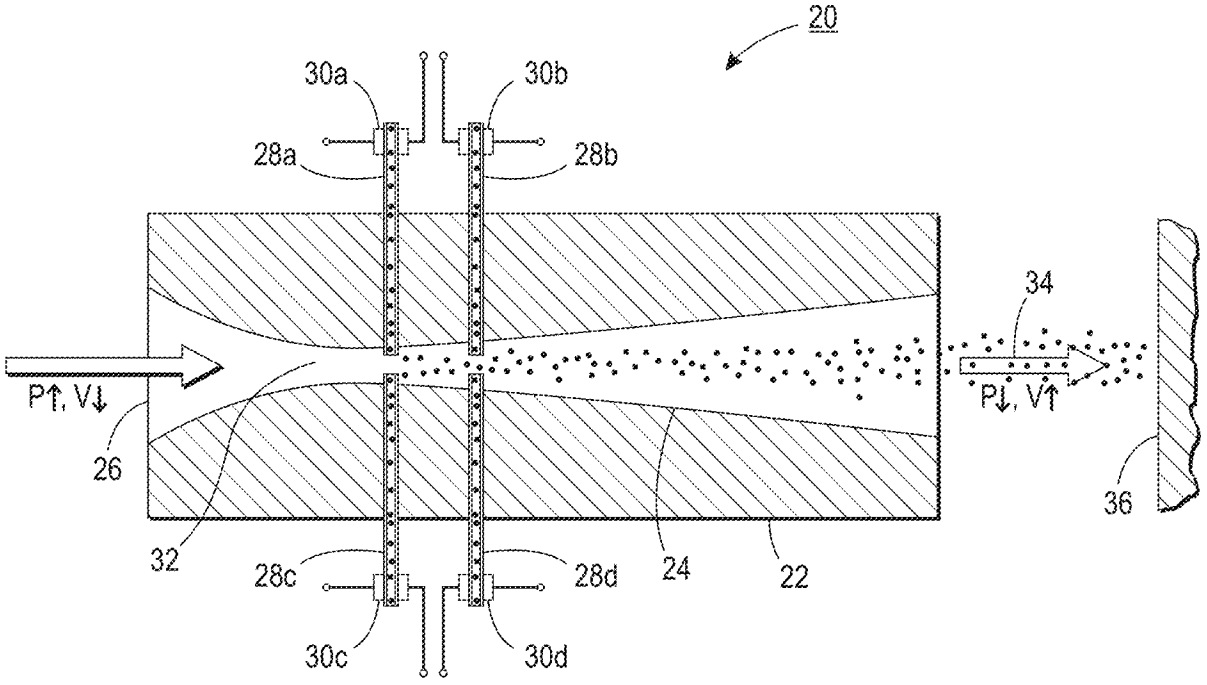
FIG. 1 PRIOR ART
FIG. 1 is a cut-away side view of a ballistic aerosol print head of a type generally known in the art.

A typical BAM printhead subsystem 20 is illustrated in FIG. 1. Subsystem 20 comprises a body 22 into which is formed a Laval-type expansion pipe 24. A carrier such as air, $CO_2$, etc. is injected at a first proximal end 26 of body 22 to form a propellant stream within pipe 24. A plurality of toner channels 28*a, b, c*, and *d* are also formed in body 22. These channels are configured to deliver a material, such as colored toner, into the propellant stream. Control of the introduction of material from channels 28*a, b, c, d* is achieved, for example, by way of an electrostatic gate 30*a, b, c, d*, respectively, or other appropriate gating mechanism. A venture feed at position 32 into pipe 24 is thereby achieved (alternatively, material from each of channels 28*a, b, c, d* may also be pressure fed into position 32). As the material and propellant stream pass through pipe 24 pressure is converted into velocity, and the contributions from each of channels 28*a, b, c*, and *d* are mixed, such that an appropriate mixture of material exits pipe 24 at roughly 1 atm as a focused, high-velocity aerosol-like jet 34, in some embodiments at or above approx. 343 m/s (supersonic). In certain embodiments, the particles in the jet 34 impact a substrate 36 with sufficient momentum that they fuse on impact.

As will be noted from FIG. 1, the long axes of channels 30*a, b, c*, and *d* are disposed roughly perpendicular to the long axis of pipe 24. That is, the particulate materials to be delivered in jet 34 are introduced at right angles to their direction of delivery. In certain application this arrangement introduces a number of complications. For example, pipe 24 is relatively long (3000 μm) in comparison to its cross-section dimensions (65 μm×65 μm) in order to permit sufficient development of velocity and mixing of the particulate materials. However, this results in viscous loss of energy (and hence inefficiency) within pipe 24. Given the perpendicular arrangement of channels 28*a, b, c*, and *d* relative to the flow of the propellant stream, vortices may form near the delivery tips of channels 28*a, b, c*, and *d*. These vortices interfere with the precise controlled delivery of the particulate material. Furthermore, the perpendicular introduction of particulate material from channels 28*a, b, c*, and *d* relative to the flow of the propellant stream may result in jet defocusing due to the particles impacting the sidewalls of pipe 24.

To address these and other complications, and provide for certain improvements in system and method operation, the present disclosure provides in-line introduction of material into a propellant stream in a BAM system and method. The propellant stream is provided symmetrically from below and above (or side-to-side, or both above-below and side-to-side) relative to particulate inlets and provided to microchannels. The symmetry of the propellant flow around the inlets causes the particulates to enter the propellant stream smoothly, generally without impacting pipe sidewalls. The propellant flow including introduced particulates is focused due to the convergence of the air stream flow inside the microchannels. Additional focusing, e.g., perpendicular to the nozzle plane, is achieved through the use of Laval Nozzles inside the microchannels. This architecture reduces the mechanical shear forces the particulates experience as they travel through the device, as the particles do not directly impact the rigid side walls of the device as much as they are surrounded by the surrounding fluid. This enables smaller diameter jets without having to use smaller rigid exit orifices, enabling smaller diameter jets with less shear stress. Smaller diameter jets enable smaller target impact regions, which improves resolution for marking application but also has advantages of less pain for drug delivery applications when the target substrate is living tissue.

Figure 2:
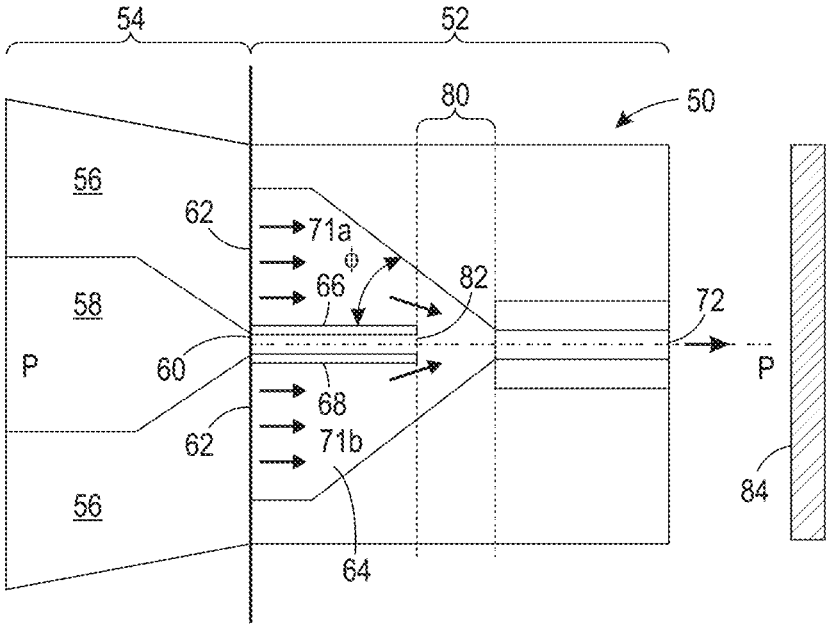
FIG. 2 is a cut-away side view of a ballistic aerosol print head according to an embodiment of the present disclosure.
Figure 3:
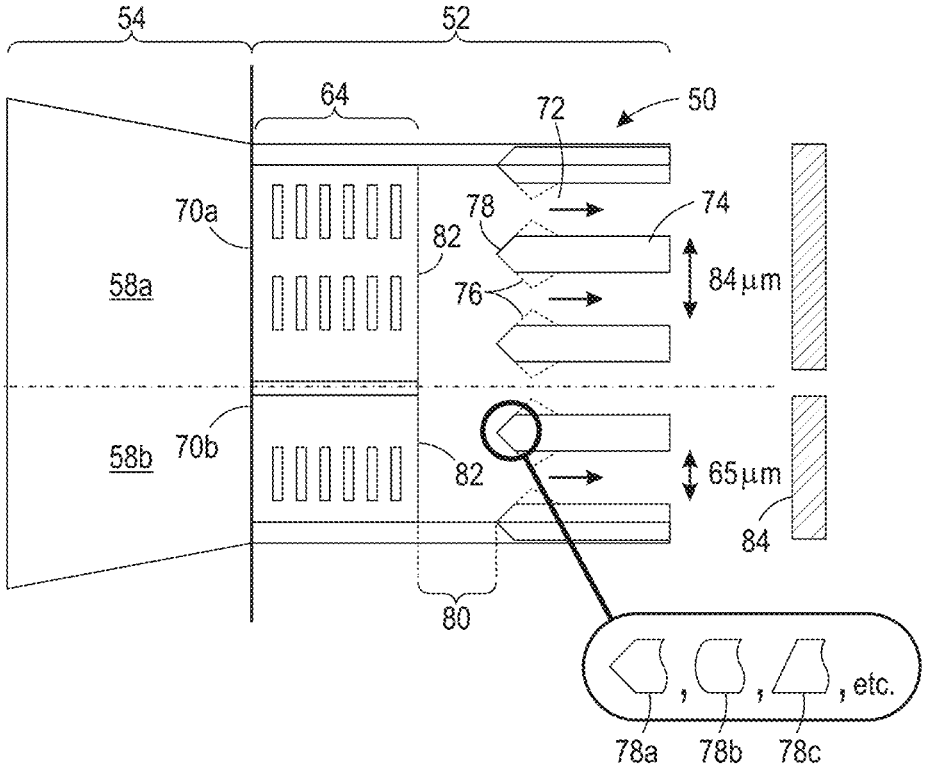
FIG. 3 is a cut-away top view of a ballistic aerosol print head according to an embodiment of the present disclosure.
Figure 4:
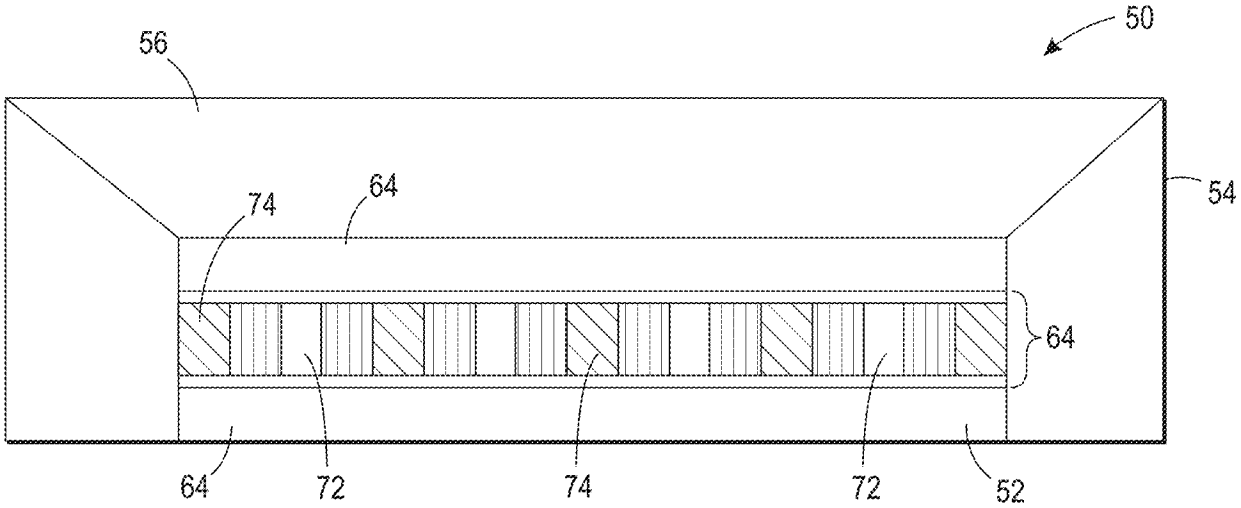
FIG. 4 is an end view of a ballistic aerosol print head according to an embodiment of the present disclosure.

FIGS. 2, 3, and 4 are side, top, and end views, respectively, of a ballistic aerosol marking system 50 according to one embodiment of the present disclosure. System 50 comprises a print head body 52 communicatively coupled to a source structure or structures 54. For the purposes of explanation, body 52 and structure 54 are shown at relatively the same scale in FIGS. 2, 3, and 4. However, in many embodiments it is contemplated that the scales of these two elements may differ by orders of magnitude, with body 52 much smaller, such as on the order of 100-500 μm in some embodiments, than structure 54, which may be on the order of several hundred mm or larger.

Source structure 54 comprises a pressurized propellant source 56 that provides a propellant acting as a carrier for particulates through and exiting body 52. The propellant may be provided by a compressor, refillable or non-refillable reservoir, material phase-change (e.g., solid to gaseous $CO_2$), chemical reaction, etc. In many embodiments, propellant provided by structure 54 may be a gas, such as $CO_2$, dehumidified ambient air, and so on. Additional details on the provision of propellant are provided in U.S. Pat. No. 6,511,149, which in its entirety is incorporated herein by reference. Source structure 54 also comprises a reservoir 58 containing particulates to be delivered by system 50. Examples of particulates include, but are not limited to particles, pellets, granules, etc. of toner, organic compounds, metals and alloys, medicines, plastic, wax, abrasives, proteins, nucleic acids, cells, and so on. Reservoir 58 may be configured to taper or focus at a distal end to an outlet port 60 in at least one dimension. Reservoir 58 may further be disposed within propellant source 56 and be configured relative thereto such that propellant passes through source 56 to an outlet port 62 over apical and base surfaces (and/or laterally opposite surface in other embodiments) and outlet port 60, as described further below.

Body 52 is configured to comprise a nozzle 64 at a first, proximal end. A particulate inlet channel 66 is disposed within nozzle 64. Particulate inlet channel 66 comprises an inlet port 68, sized and positioned relative to outlet port 60 of reservoir 58 to receive particulates therefrom. Optionally, particulate inlet channel 66 may further comprise one or more combined particle transport and metering assemblies (μATOM movers) 70*a*, 70*b*, such as disclosed in aforementioned U.S. Pat. No. 6,511,149. Where appropriate, material transport and metering may be accomplished by one or more of various different systems and methods, and the μATOM movers 70*a, b* are merely one example. Particulate inlet channel 66 is disposed within nozzle 64 so as to be substantially uniformly spaced apart from at least first and second opposite surfaces of said nozzle, such as above and below or left and right sides (or both), to thereby define substantially symmetrical first and second flow regions 71*a*, 71*b* between particulate inlet channel 66 and the at least two opposite surfaces of nozzle 64.

Body 52 further comprises one or more microchannels 72 defined by wall structures 74. Microchannels 72 may be defined by patterned etching, or other appropriate processes, in a silicon or similar body. For example, arrays of microchannels 72 may be etched into Si wafers, or alternatively are etched into polymer layers laminated onto glass substrates, and fitted into body structure 52. Wall structures 74 may be provided with nozzle profiles 76 and/or end treatments 78 (such as a proximal end having a wedged, radiused, or angled planform 78*a*, 78*b*, 78*c*, respectively). Microchannels 72 (and wall structures 74) are spaced apart from particulate inlet channel 66 by a collection region 80, for example by a distance of 10-100 μm.

According to certain embodiments, the nozzle structure used to converge the air from a macroscopic pressure supply into the microchannels is milled out of glass, plastic (e.g., Plexiglas), etc. Furthermore, according to certain embodiments, in order to obtain alignment of the μAtom movers 70*a, b* with the microchannels 72, side walls with well-aligned groves (not shown) for sliding in chips containing the μAtom movers and microchannels can be used.

In operation, particulates are supplied from reservoir 58 to particulate inlet channel 66, such as by gravity, positive- or negative-pressure, electrostatics, etc. A propellant is supplied by pressurized propellant source 56 above and below (and/or on each side of) particulate inlet channel 66. The propellant is focused into microchannels 72 by nozzle 64, symmetrically aligned to the particulate inlet channel 66. μATOM movers 70*a, b* meter a controlled amount of particulates into the propellant stream at outlet ports 82. The metering of particulates, together with the flow of the propellant past outlet ports 82 carries the particulates toward and through microchannels 72. The velocity of the propellant and particulates is increased by the nozzle profiles of the microchannels 72 such that a high-velocity focused stream of particles exit the channels to be directed, for example, to a substrate 84.

Figure 5:
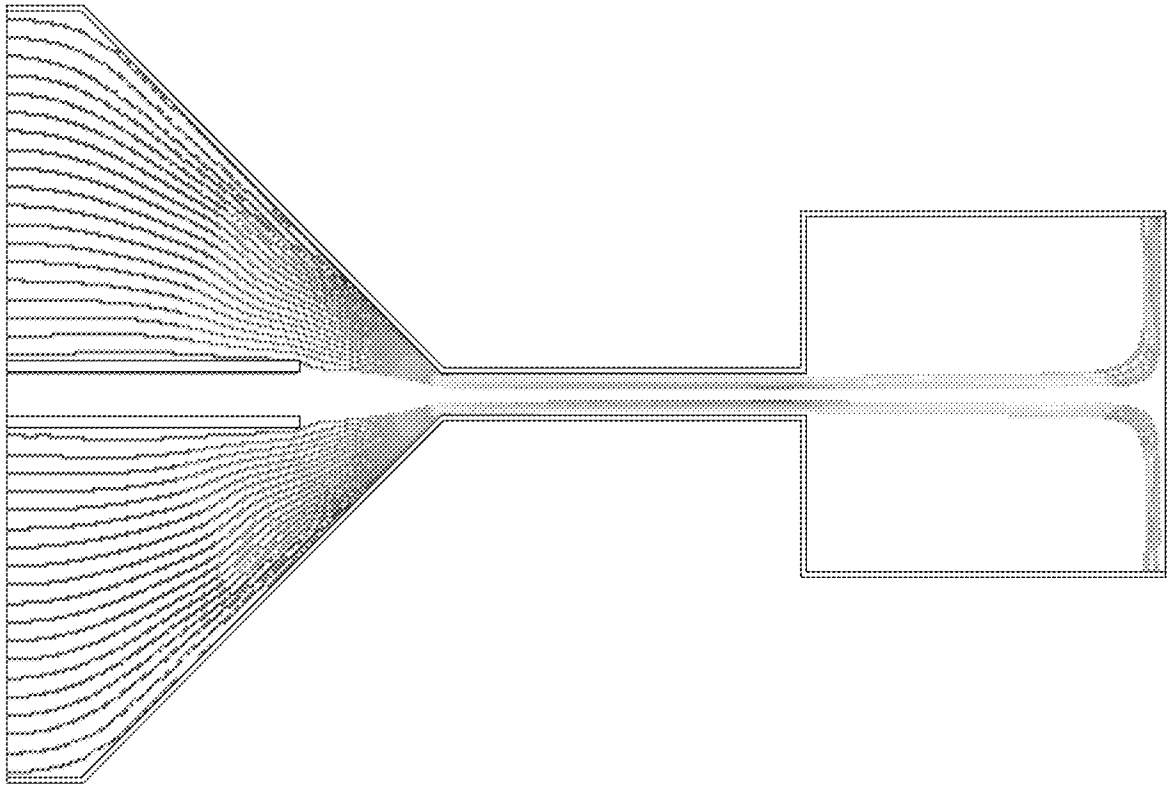
FIG. 5 is a particle trace model illustrating streamline velocity magnitude by position for a modeled print head according to an embodiment of the present disclosure.
Figure 6:
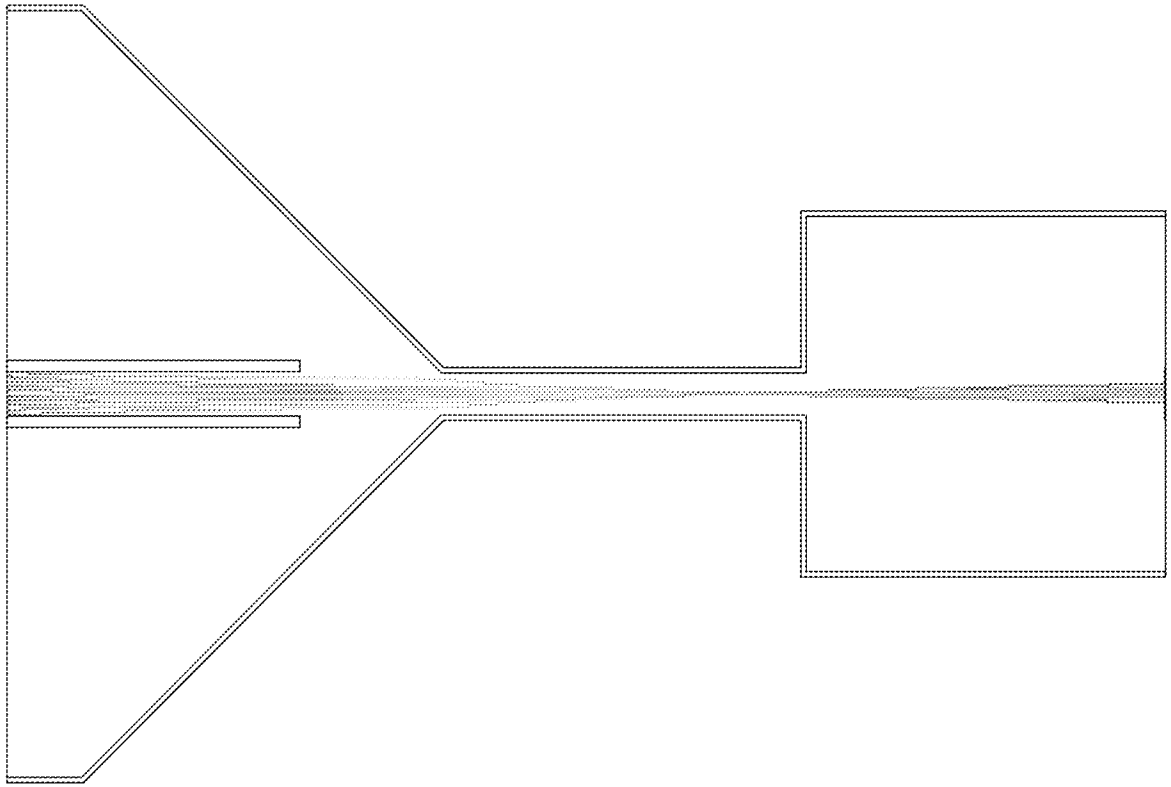
FIG. 6 is a particle trace model illustrating particle trajectories for a modeled print head according to an embodiment of the present disclosure.

A print head according to the above geometry was modeled and various aspects of the modeled device examined, and illustrated in FIGS. 5 and 6. The model included an input pressure of 1.25 atm at the reservoir input and 1.3 atm at the microchannel input. FIG. 5 is a particle trace model illustrating streamline velocity magnitude by position, with particle flow from left to right in the figure. As can be seen, the above-described print head geometry with propellant provided symmetrically above and below (or on each side or both) of the particulate source results in a smooth convergence of the air stream lines around the particulate inlet channels and into the microchannels. FIG. 6 is a particle trace model illustrating particle trajectories, again with particle flow from left to right in the figure. It can be seen that the disclosed print head geometry provides "smooth" trajectories of the injected particulates.

Figure 7:
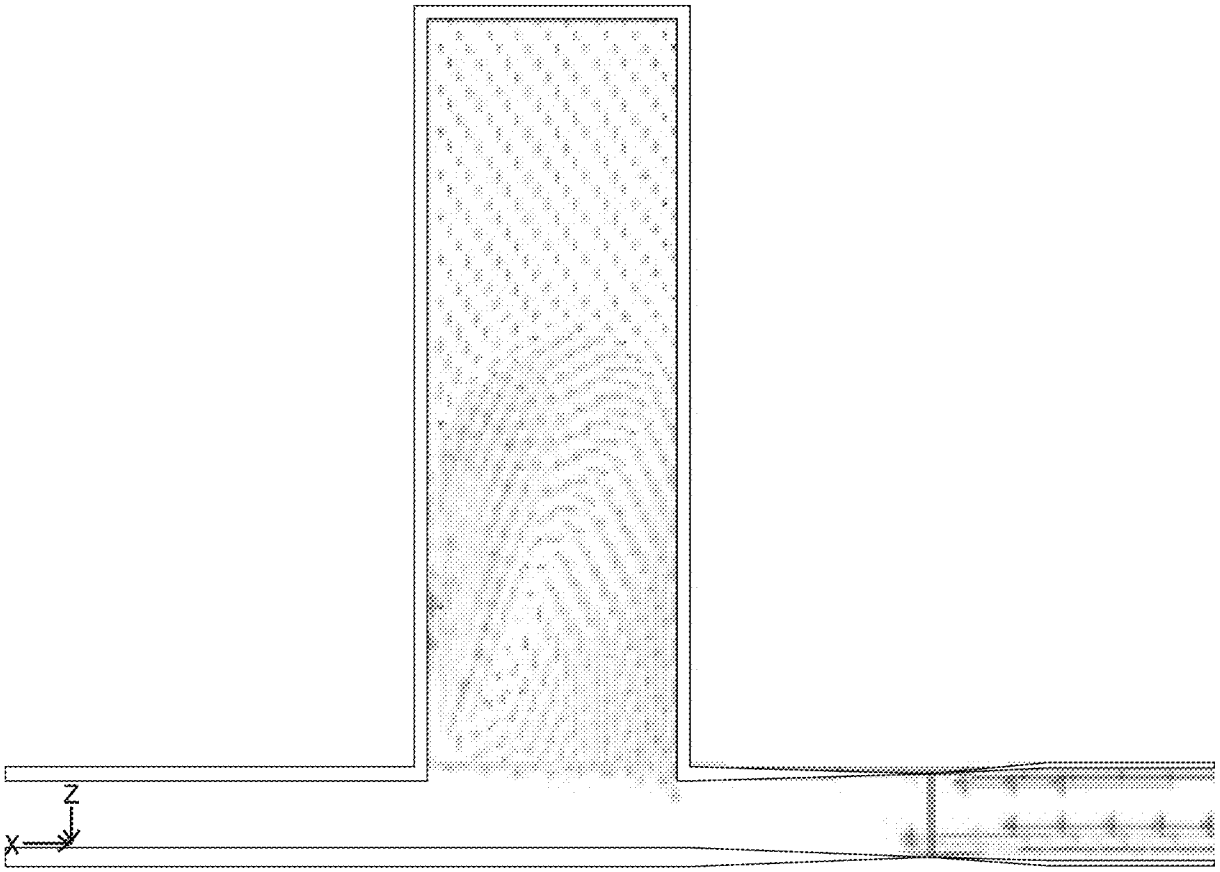
FIG. 7 PRIOR ART
FIG. 7 is particle trace model illustrating velocity vectors by position for a print head of a type generally known in the art.
Figure 8:
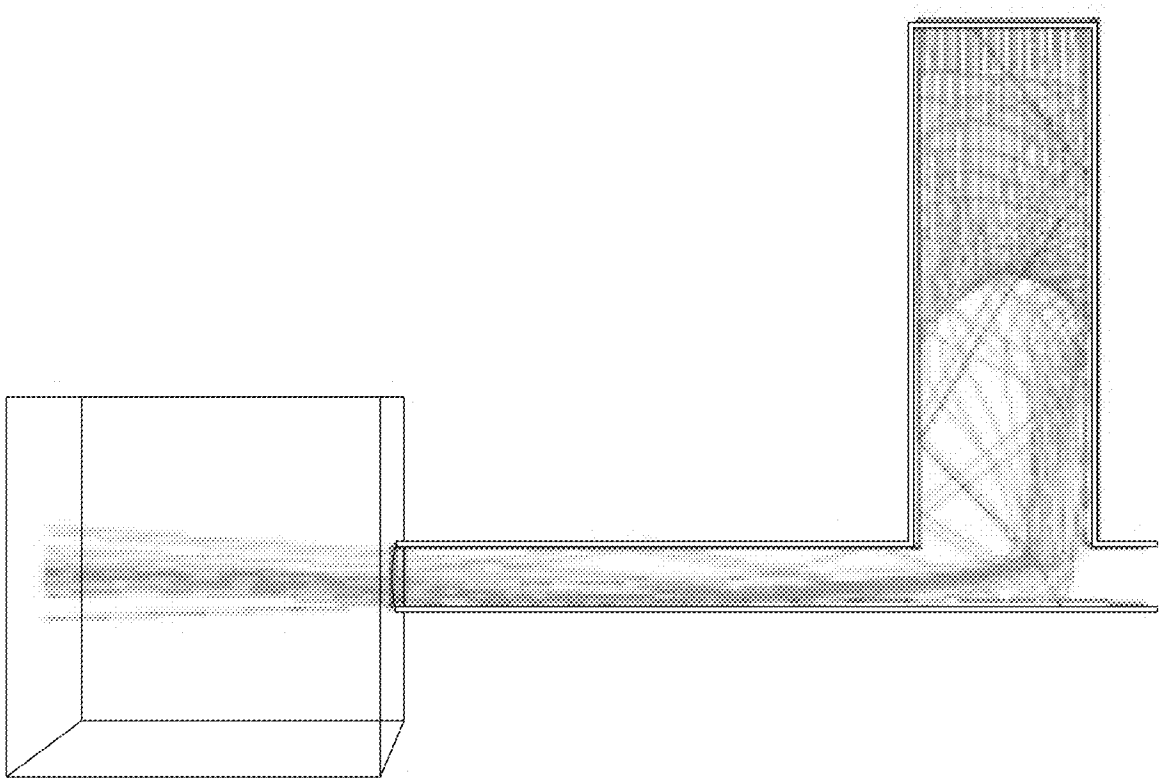
FIG. 8 PRIOR ART
FIG. 8 is particle trace model illustrating particle trajectories by position for a print head of a type generally known in the art.

The conditions illustrated in FIGS. 5 and 6 are in contrast to known designs, in which the particulate inlets are perpendicular to the microchannels. In these known designs, a vortex forms inside the toner inlet leading to multiple collisions of the particulates with the walls when entering the main air stream, as illustrated in FIGS. 7 and 8, which are particle trace models of a selected known print head geometry illustrating velocity magnitude and particle trajectories by position, respectively, with particle flow from right to left in each. (The model of the print head used in FIGS. 7 and 8 includes a 4 mm long by 84 μm wide channel, with a Laval nozzle at the right end of a 750 μm high toner inlet. Air pressure was set to 6 atm. The pressure at the toner inlet was 1 atm.) FIGS. 7 and 8 illustrate certain inefficiencies of the prior art BAM print head designs, and highlight the advantages provided by the present design for certain applications.

Referring again to FIG. 2, the angle $\phi$ of the nozzle 64 that converges the air into the microchannels 72 controls the pressure needed inside the inlet channels 66 to prevent air flowing into the inlets. As $\phi$ decreases, the velocity v of the air increases around the particulate inlet exits. Because the total pressure remains constant, the static pressure at the inlet exits, which has to be balanced inside the inlets to prevent back flow, decreases due to Bernoulli's law:

$$P_{total} = P_{static} + \frac{\rho}{2}v^2$$

The particulates are introduced into the air stream in front of microchannels 72. The particulates are therefore focused inside microchannels 72 in the nozzle plane due to the converging air stream lines (FIG. 6). This allows optimizing the output spot (e.g., pixel) size by choosing the proper microchannel length.

Figure 9:
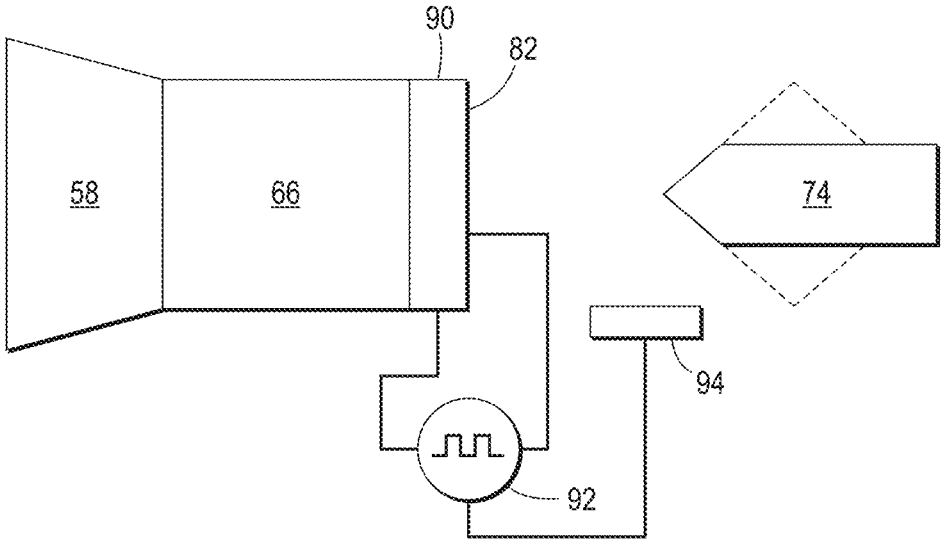
FIG. 9 is a cut-away top view of a ballistic aerosol print head according to another embodiment of the present disclosure.

Smooth particulate trajectories may be obtained from a slow, but continuous, propellant stream from the particulate inlet channels 66 into microchannels 72. According to one embodiment illustrated in FIG. 9, valving of charged particulates is achieved through a gating electrode 90 at outlet port 82 that is switched between an ON and OFF state, such as by controller 92. The gating voltage may be controlled as a function of the propellant flow velocity from the inlet channels 66 into microchannels 72, such as may be calculated from static pressure inside the particulate inlets or measured by an appropriate sensor(s) 94.

Figure 10:
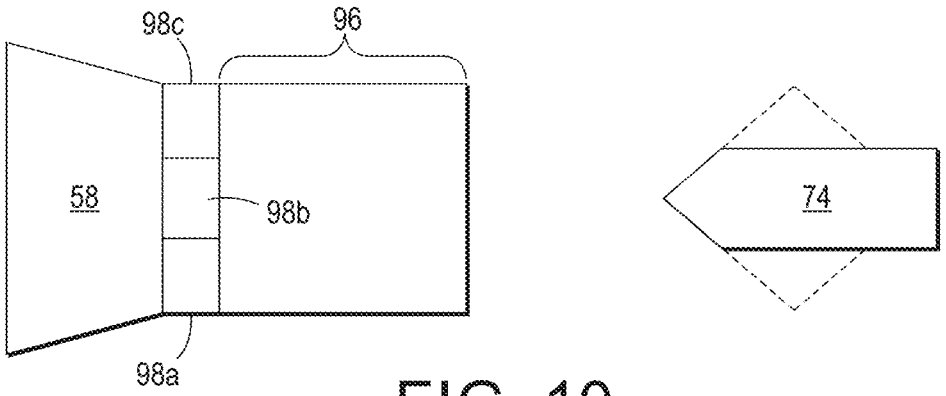
FIG. 10 is a cut-away top view of a ballistic aerosol print head according to still another embodiment of the present disclosure.

In an alternate embodiment illustrated in FIG. 10, instead of controlling the particulate supply to the individual microchannels by individual μAtom tracks, a single print head-wide μAtom mover 96 may continuously transport particulates to the microchannels, with individual electrodes 98*a*, 98*b*, 98*c*, etc. (away from the outlet port 82) gating particulates onto this μAtom mover. It will be appreciated, however, that a transport subsystem may not be required for all embodiments. For example, in drug delivery embodiments, dosing may be controlled by a set volume of the drug to be delivered contained within a reservoir (e.g., the dosage consuming the full contents of the reservoir). In the case of delivery of particulate of a drug, a "cloud" of the particulates may be formed, for example by a fluidizer or other known mechanism.

Figure 11:
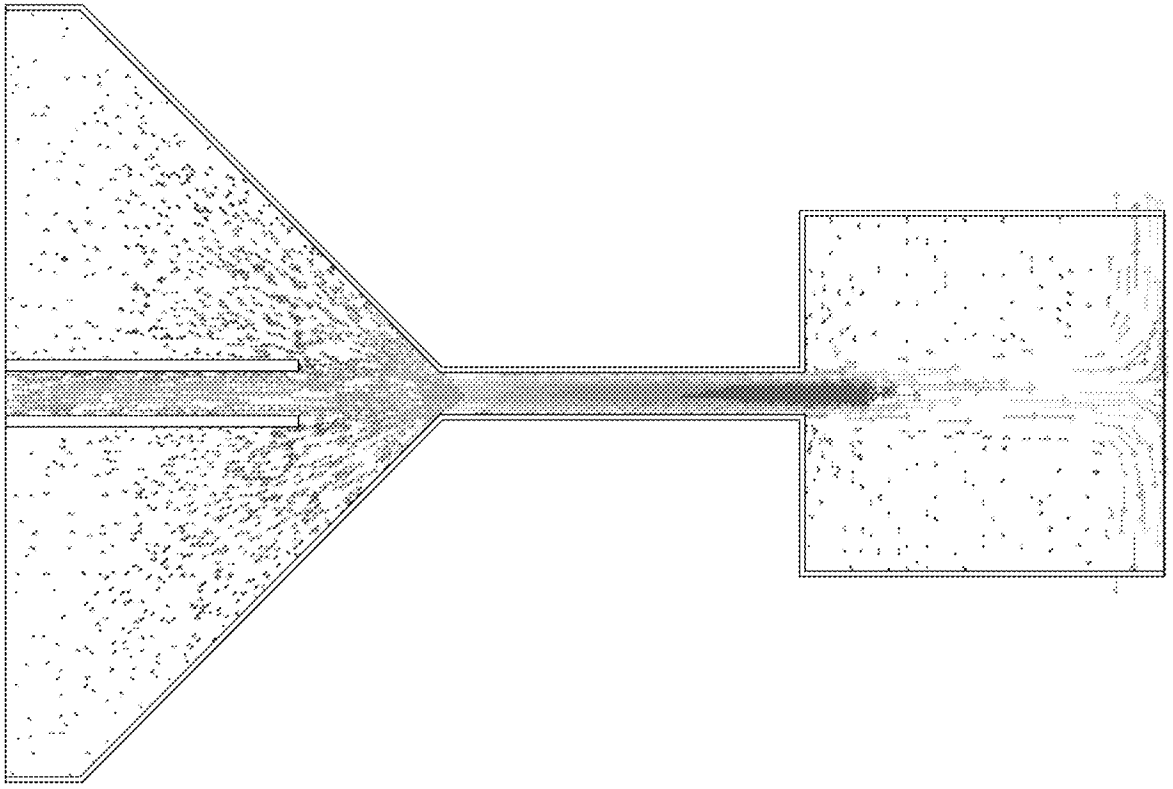
FIG. 11 is a trace model illustrating propellant velocity by position for a modeled print head according to another embodiment of the present disclosure.
Figure 12:
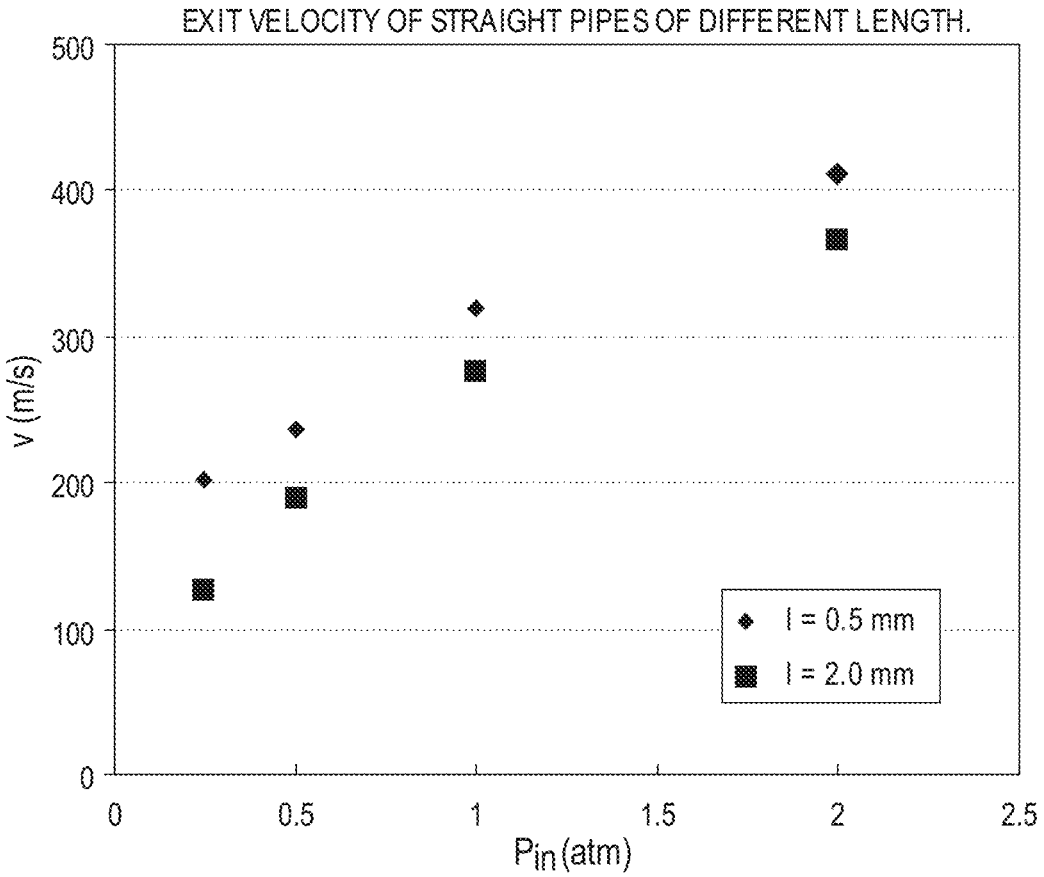
FIG. 12 is a plot of propellant input pressure versus propellant velocity for two different channel lengths according to embodiments of the present disclosure.

Among the several advantages provided by the print head geometry disclosed herein is the use of shorter microchannels than suggested in existing designs. According to the present disclosure, the microchannels are needed primarily or exclusively (depending on the configuration) for the final focusing of the propellant jets onto a substrate. All the other parts of the propellant supply are kept at macroscopic (>1 mm) dimensions. With less viscous losses inside the microchannels less input pressure is needed to accelerate the propellant to high (e.g., supersonic) speeds, as illustrated by FIG. 11 (velocity vectors of propellant flow, flow from left to right in the figure) and FIG. 12 (propellant/particle exit velocities as a function of channel length).

Figure 13:
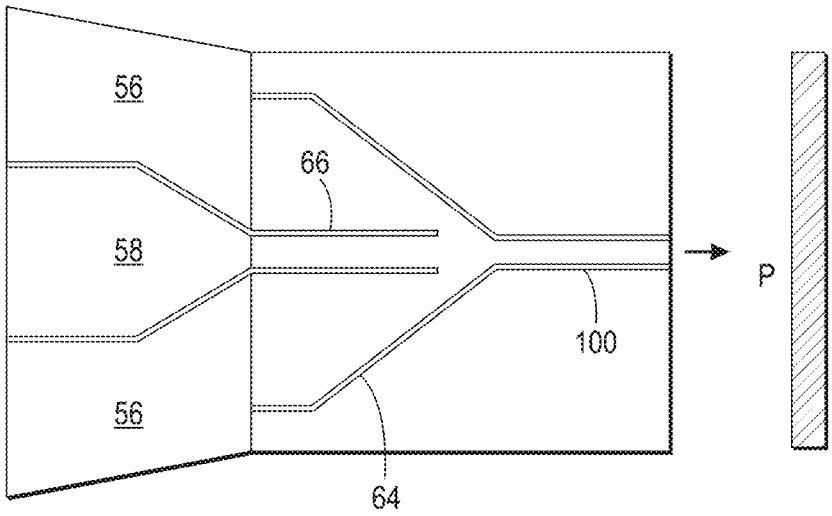
FIG. 13 is a cut-away side view of a ballistic aerosol print head according to yet another embodiment of the present disclosure.

According to an alternative design of the print head illustrated in FIG. 13, microchannels are not provided. Nozzle 64 directly focuses the propellant through a micro slit 100. In certain embodiments, this requires that the length of the micro slit 100 be increased as compared to microchannel embodiments. This length may be on the order of several cm or longer. In these embodiments provisions may also be made to reduce turbulence at the micro slit.

As previously discussed, charged particulates may be supplied to individual microchannels by individual mAtom movers 70*a*, 70*b* and so on. That is, one or more μAtom movers may be disposed within inlet channels 66. In certain embodiments, each μAtom mover may be communicatively coupled to a unique particulate reservoir, such as 58*a*-70*a* and 58*b*-70*b* illustrated in FIG. 3. μAtom movers 70*a*, 70*b* may be connected to macroscopic Atom movers (not shown), which supply the particulates out of a (macroscopic) fluidized bed. In general, resolution of the print head is determined by the density of μAtom movers, gating electrodes, and microchannels employed. In one example, microchannels and μAtom movers provide a print resolution of up to 300 dpi, however, other print resolutions are contemplated by the present disclosure.

It should be understood that when a first portion of a structure disclosed herein is referred to as being "on" or "over" a second portion, it can be directly on the second portion, or on an intervening structure or structures may be between the first and second portions. Further, when a first portion is referred to as being "on" or "over" a second portion, the first portion may cover the entire second portion or only a part of the second portion.

The physics of modern micromechanical devices and the methods of their production are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term) and/or description. While as difficult to precisely define as the limitations of the present disclosure themselves, we intend that this term be interpreted as "to a large extent", "as nearly as practicable", "within technical limitations", and the like.

While examples and variations have been presented in the foregoing description, it should be understood that a vast number of variations exist, and these examples are merely representative, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described examples may be made without departing from the spirit and scope of the disclosure defined by the claims thereto.

What is claimed is:

1. An apparatus for selectively depositing a material onto a substrate, comprising:

a material ejector body defining a nozzle and an exit channel therein, the exit channel having a rectangular cross section;

a plurality of microchannels disposed within the exit channel;

a material inlet channel disposed within said nozzle and substantially uniformly spaced apart from at least first and second opposite surfaces of said nozzle to thereby define substantially symmetrical first and second flow regions between said material inlet channel and said at least two opposite surfaces of said nozzle, each of the two opposite surfaces of said nozzle arranged at a first angle $\varphi<90$ degrees with respect to a longitudinal axis of the material inlet channel, the material inlet channel longitudinally aligned with the exit channel and having an outlet facing the exit channel, said exit channel having a first wall and a second opposing wall, each of said first and second walls of said exit channel arranged at a second angle with respect to the longitudinal axis of the material inlet channel, wherein said second angle is different than said first angle;

a collection region disposed between the first and second walls and the outlet of the material inlet channel;

a material reservoir communicatively coupled to said material inlet channel for delivery of said material;

a propellant source communicatively coupled to said nozzle;

said material inlet channel disposed relative to said propellant source and within said nozzle such that propellant provided by said propellant source flow substantially uniformly past said material inlet channel within said first and second flow regions;

wherein:

material may be provided by said reservoir to said material inlet channel, carried from said material inlet channel by propellant flowing substantially uniformly past said material inlet channel within said first and second flow regions, and carried by said propellant to exit said material ejector body through said exit channel toward said substrate.

2. The apparatus of claim 1, wherein each microchannel comprises a wall structure defining a nozzle profile therein.

3. The apparatus of claim 2, wherein said wall structure comprises a longitudinal body having a proximal end and a distal end, and wherein said proximal end comprises an end treatment selected from the group consisting of: a radius planform, a wedge planform, and an angled planform.

4. The apparatus of claim 1, wherein said propellant has a flow direction through said body, and wherein said exit channel is spaced apart from said material channel in said flow direction by a distance between 10 and 100 μm.

5. The apparatus of claim 1, wherein said material is selected from the group consisting of: marking materials visible to an unaided eye; marking materials not visible to an unaided eye; surface finish material; chemical materials; biological materials; medicinal materials; therapeutic materials; manufacturing materials; medicine; and immunization material.

6. The apparatus of claim 1, wherein said material inlet channel is provided with at least one electrostatic transport subsystem.

7. The apparatus of claim 6, wherein said material inlet channel is provided with a plurality of independently controllable electrostatic transport subsystems.

8. The apparatus of claim 7, further comprising a plurality of material reservoirs, each said material reservoir communicatively coupled to an independently controllable electrostatic transport subsystem.

9. The apparatus of claim 6, further comprising a controller for controlling said at least one electrostatic transport subsystem as a function of propellant flow velocity between said material inlet channel and said exit channel.

10. The apparatus of claim 9, further comprising a flow sensor communicatively coupled to said controller and disposed with a region between said material inlet channel and said exit channel, said controller controlling said at least one electrostatic transport subsystem responsive to data provided by said flow sensor.

11. The apparatus of claim 1, wherein said substrate comprises a portion of a body, and further wherein said reservoir is sized and configured to contain a single dosage of a material to be administered by said apparatus to said body.

12. The apparatus of claim 1, wherein said material inlet channel is provided with at least one gating electrode disposed proximate said material reservoir.

13. The apparatus of claim 1, wherein said exit channel defines an exit flow plane, and further wherein said material inlet channel lies in said exit flow plane.

14. The apparatus of claim 1, wherein the material comprises a pharmaceutical material.

15. The apparatus of claim 1, wherein the material ejector body is configured to deliver a drug to a biological tissue.

16. The apparatus of claim 15, wherein the material ejector body is configured to transdermally deliver the drug to the biological tissue.

17. The apparatus of claim 1, wherein said first wall of the exit channel is parallel to the opposing second wall of the exit channel.

* * * * *